United States Patent [19]

Kollen et al.

[11] Patent Number: 4,723,678

[45] Date of Patent: Feb. 9, 1988

[54] CONTAINER AND CLOSURE ASSEMBLY

[75] Inventors: Wendell J. Kollen, Maumee; Elizabeth A. Lofgren, Waterville, both of Ohio

[73] Assignee: Owens-Illinois Plastic Products Inc., Toledo, Ohio

[21] Appl. No.: 922,227

[22] Filed: Oct. 23, 1986

[51] Int. Cl.[4] ..... B65D 53/04

[52] U.S. Cl. ..... 215/347

[58] Field of Search ..... 215/347

[56] References Cited

U.S. PATENT DOCUMENTS

| | | | |
|---|---|---|---|
| 2,188,942 | 2/1940 | Eisen | 215/347 |
| 3,823,840 | 7/1974 | Zachkeim | 215/347 |
| 4,640,428 | 2/1987 | Chang | 215/347 |

FOREIGN PATENT DOCUMENTS

| | | | |
|---|---|---|---|
| 2415247 | 9/1979 | France | 215/347 |
| 148688 | 11/1979 | Japan | 215/347 |

*Primary Examiner*—Donald F. Norton
*Attorney, Agent, or Firm*—H. G. Bruss

[57] ABSTRACT

A container and closure assembly in which the container has a finish portion and the closure is secured to the finish. A circular flexible rubbery sealing liner is located at the top of the container finish and below the cap, and a circular barrier liner that is printable if desired, is provided between the closure top and the flexible liner to reduce the passage of permanents such as $O_2$ and $CO_2$ therethrough.

14 Claims, 3 Drawing Figures

CONTAINER AND CLOSURE ASSEMBLY

The present invention relates to a container and closure assembly in which there is a barrier liner located between the container finish portion and the closure top.

BACKGROUND OF THE INVENTION

U.S. Pat. No. 3,823,840 to Zackheim discloses a closure and container assembly with a prepunctured closure that permits the insertion of a plastic canula through the closure so a dosage can be removed without exposure of the container contents. The Zackheim patent shows a prepunctured rubbery sealing liner 24 with a slit 38. The top of the closure has a tear tab 34 and below the top of the closure and tear tab is located a thin barrier layer 26 of tearable material such as aluminum foil. The rubbery liner 24 is designed to reseal itself upon use, the tear tab and barrier layer remaining torn. In one embodiment, a removable section 38 is provided in the barrier layer 26 so there is access to the slit 38.

It is desirable to have a container and closure assembly that has no slits and removable portions, and yet is provided with a barrier layer for barrier properties as well as a barrier layer that is printable.

OBJECTS OF THE INVENTION

It is an object of the present invention to provide a container and closure assembly having a barrier layer that is intact and does not have removable portions, the assembly providing a barrier layer that reduces the passage of $O_2$ and $CO_2$ and other permeants therethrough and a barrier layer that is easily printable.

It is an object of the present invention to provide an improved container and closure assembly, the assembly comprising a container having a neck portion with a finish portion having threads, a closure in combination with the container, the closure having a top and an annular skirt depending therefrom with thread-receiving means inside the skirt for engaging the threads of the container, a flexible rubbery sealing liner provided at the top of the container finish, the liner being a generally circular sealing member when the closure is tightened down over the container finish portion, there being a generally circular printable barrier liner substantially superimposed on the flexible liner and located next to the cap of the closure, the barrier liner reducing the permeation of $O_2$ and $CO_2$ and other permeants therethrough.

These and other objects will be apparent from the specification that follows, the appended claims, and the drawings in which:

SUMMARY OF THE INVENTION

The present invention provides a container and closure assembly in which the container has a finish portion with a top and with means for securing the closure at the finish portion, the closure having a top and an annular skirt depending therefrom with means on the inside of the skirt for attaching the closure to the finish, the assembly including a circular flexible rubbery sealing liner positioned at the top of the container finish and below the closure top, the improvement of the present invention in the assembly comprising providing a circular barrier liner between the closure top and the flexible liner to reduce the passage of permeants such as $O_2$ and $CO_2$ therethrough.

The present invention also provides a closure for a container having a top and neck and a container portion near the top, the closure having a top and an annular depending skirt with means inside the skirt for fastening the closure to the container neck portion, the closure having a generally circular flexible sealing liner at the top of the container, and a generally circular barrier liner between the flexible liner and the top of the cap for reducing the permeation of $O_2$ and $CO_2$ and other permeants through the flexible liner and top of the closure when the closure is fastened over the container and when the container has a product therein that would deteriorate with passage of $O_2$ and $CO_2$ or other permeants through the top of the closure.

DETAILED DESCRIPTION OF THE PREFERRED EMBODIMENTS

Figure 1:
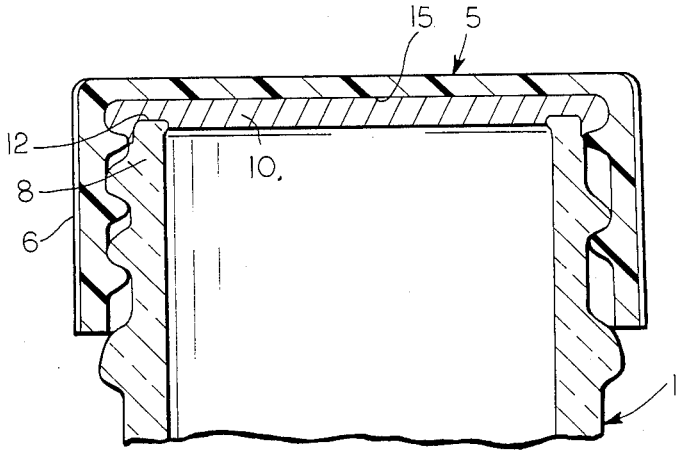
FIG. 1 PRIOR ART
FIG. 1 is a sectional view of a closure and container assembly of the prior art.

As seen in the drawings, FIG. 1 shows the prior art construction of a container 1 and a closure 5 having an annular skirt 6, the closure fitting over a finish portion 8 of the container 1. The prior art assembly includes an annular flexible rubbery sealing liner 10 position at the top 12 of the container finish portion 8. The liner 10 is positioned between the closure top 15 and the container finish 8.

Figure 3:
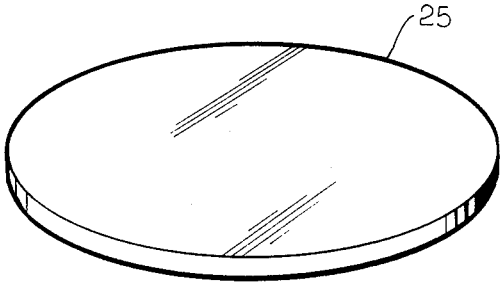
FIG. 3 is a perspective view of the barrier liner of the present invention.
Figure 2:
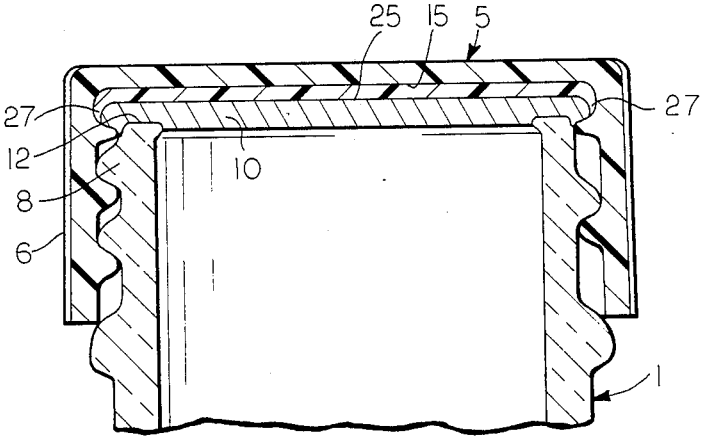
FIG. 2 is a sectional view of the closure and container assembly of the present invention including a generally circular barrier liner between the closure top and a flexible rubbery liner.

The container and closure assembly of the present invention is shown in FIG. 2 in which there is provided a circular barrier liner 25 between the closure top 15 and the flexible rubbery liner 10. The barrier liner 25 reduces the passage of permeants such as $O_2$ and $CO_2$ through the closure top.

It is preferred that the barrier liner 25 be made of a copolymer of ethylene and vinyl alcohol although barrier materials such as aluminum, polyvinylidene chloride, nylons and nitrile polymers, in some cases, can be used. The barrier liner can be made of layers of the material, if desired.

Good results have been obtained when the closure is plastic and the container is glass, although the container can be plastic.

In one embodiment shown in FIG. 2, the thickness of the barrier liner 25 is about equal to or is almost as much as that of the sealing liner 10. Also in FIG. 2, the barrier liner 25 is adjacent the liner 10 and substantially fills the space between the liner 10 and the top 15 of the closure, an annular peripheral lip 27 of the liner 25 being formed as the liner is wedged between the cap skirt and the liner 15.

In some applications, such as when the container holds ketchup, the reduction of the passage of $O_2$ through the closure is important for good shelf life. When the container is for carbonated beverages, the reduction in the passage of $CO_2$ as well as $O_2$ is important.

In a preferred embodiment, the barrier liner 25 is printable whereby indicia including promotional and advertising information can be provided on the top side of the liner 25. The liner 25 can be easily and efficiently printed upon before insertion into the assembly, thus fitting into a highspeed manufacturing process as well as customized processes and short runs.

The liner 25, if desired, can be a single layer or a multi-layer structure, the liner 25 being usable alone or in combination with a liner material such as polyvinylchloride.

In accordance with the present invention, the use of the barrier layer 25 has the advantage of reducing permeation of gases such as $O_2$ and $CO_2$ through the cap and the advantage providing an easily printed surface.

What is claimed is:

1. In a container and closure assembly in which the container has a finish portion with a top and with means for securing the closure at the finish portion, the closure having a top and an annular skirt depending therefrom with means on the inside of the skirt for attaching the closure to the finish, the assembly including an annular flexible rubbery sealing liner positioned at the top of the container finish and below the closure top, the closure top being of solid plastic with no slots or breakaway portions, the sealing liner being solid with no slits; the improvement comprising a circular barrier liner between the closure top and the flexible liner to reduce the passage of permeants such as $O_2$ and $CO_2$ therethrough, the barrier liner substantially filling the space between the closure top and sealing liner, the barrier liner having an outer periphery portion that overlaps the sealing liner to form an outer barrier annular downturned lip that is wedged between the closure and the sealing liner.

2. An assembly as defined in claim 1 in which the barrier liner is made of an ethylene/vinyl alcohol copolymer.

3. An assembly as defined in claim 1 in which the barrier liner is aluminum.

4. An assembly as defined in claim 1 in which the barrier liner is an ethylene/vinyl alcohol copolymer.

5. A container having a neck portion with a finish portion having threads, a closure in combination with the container, the closure having a top and an annular skirt depending therefrom with thread-receiving means inside the skirt for engaging the threads of the container, a flexible rubbery sealing liner provided at the top of the container neck, the liner being a generally circular sealing member when the closure is tightened down over the container neck portion, the closure top being of solid plastic with no slots or breakaway portions, the sealing liner being solid with no slits, there being a generally circular printable barrier liner substantially superimposed on the flexible liner and located next to the cap of the closure, the barrier liner being made of a barrier plastic and reducing the permeation of $O_2$ and $CO_2$ therethrough, the barrier liner substantially filling the space between the closure top and sealing liner, th barrier liner having an outer periphery portion that overlaps the sealing liner to form an outer barrier annular downturned lip that is wedged between the closure and the sealing liner.

6. An assembly as defined in claim 5 in which the thickness of the barrier liner is almost as much as that of the sealing liner.

7. An assembly as defined in claim 5 in which the container is glass.

8. An assembly as defined in claim 5 in which the container is plastic.

9. An assembly as defined in claim 5 in which the barrier liner is polyvinylidene chloride.

10. A closure for a container having a top and neck and a container portion near the top, the closure having a top and an annular depending skirt with means inside the skirt for fastening the closure to the container neck portion, the closure having a generally circular flexible sealing liner at the top of the container, the closure top being of solid plastic with no slots or breakaway portions, the sealing liner being solid with no slits, and a generally circular barrier liner made of a barrier plastic between the flexible liner and the top of the cap for reducing the permeation of $O_2$ and $CO_2$ through the flexible liner and top of the closure when the closure is fastened over the container and when the container has a product therein that would deteriorate with the passage of $O_2$ and $CO_2$ through the top of the closure, the barrier liner substantially filling the space between the closure top and sealing liner, the barrier liner having an outer periphery portion that overlaps the sealing liner to form an outer barrier annular downturned lip that is wedged between the closure and the sealing liner.

11. A closure as defined in claim 10 in which the barrier liner is an ethylene/vinyl alcohol copolymer.

12. A closure as defined in claim 10 in which the barrier liner is printable.

13. A closure as defined in claim 10 in which the barrier liner is polyvinylidene chloride.

14. A closure as defined in claim 10 in which the barrier liner is about as thick as the sealing liner.

* * * * *